US005931151A

United States Patent [19]

Van Dore et al.

[11] Patent Number: 5,931,151

[45] Date of Patent: Aug. 3, 1999

[54] RANGE FOR A RECREATIONAL VEHICLE WITH NOTCHED CONTROL PANEL

[75] Inventors: Jonathan P. Van Dore; Kenneth R. Parker, both of Minneapolis, Minn.

[73] Assignee: Atwood Industries, Inc., Rockford, Ill.

[21] Appl. No.: 08/872,486

[22] Filed: Jun. 7, 1997

[51] Int. Cl.[6] ..... F24C 15/10

[52] U.S. Cl. ..... 126/214 B; 126/37 R; 126/39 B; 126/214 A

[58] Field of Search ..... 126/214 B, 214 A, 126/37 R, 39 R, 273 R, 273 A, 214 R, 211, 39 B, 37 B; 4/660; 108/64; 312/111, 203

[56] References Cited

U.S. PATENT DOCUMENTS

| | | | |
|---|---|---|---|
| 2,880,479 | 4/1959 | Evans et al. | 126/214 B |
| 2,897,812 | 8/1959 | Albrecht | 126/214 B |
| 3,051,160 | 8/1962 | Nielsen | 126/37 R |
| 3,142,295 | 7/1964 | Blee | 126/37 R |
| 3,169,518 | 2/1965 | Scott | 126/39 R |
| 3,213,847 | 10/1965 | Scott | 126/37 R |
| 3,267,492 | 8/1966 | Jenkins | 4/660 |
| 3,376,861 | 4/1968 | Bach, Jr. | 126/214 B |
| 3,385,284 | 5/1968 | White | 126/214 B |
| 3,402,281 | 9/1968 | Vonderhaar | 126/273 R |
| 3,446,201 | 5/1969 | More | 126/39 R |
| 4,004,570 | 1/1977 | Keeling, Sr. | 126/214 B |
| 4,400,045 | 8/1983 | Baschin | 126/37 R |
| 5,429,114 | 7/1995 | Taplan et al. | 126/214 A |

*Primary Examiner*—James C. Yeung
*Assistant Examiner*—Josiah C. Cocks
*Attorney, Agent, or Firm*—Banner & Witcoff, Ltd.

[57] ABSTRACT

A range for a recreational vehicle which is adapted to be fit into a simple rectangular opening provided in a kitchen cabinet of the recreational vehicle. The present invention provides a range having a control panel on its front face with notched sides. The notched sides are provided to receive the corners of the countertop to thereby allow the rectangular opening created in the kitchen cabinet to have a simple rectangular shape and to thereby eliminate the labor-intensive process of creating notches in the corners of the countertop. Moreover, by providing the control panel as a piece formed from a unitary sheet of metal, the assembly process for the range is additionally streamlined.

10 Claims, 3 Drawing Sheets

Fig. 1
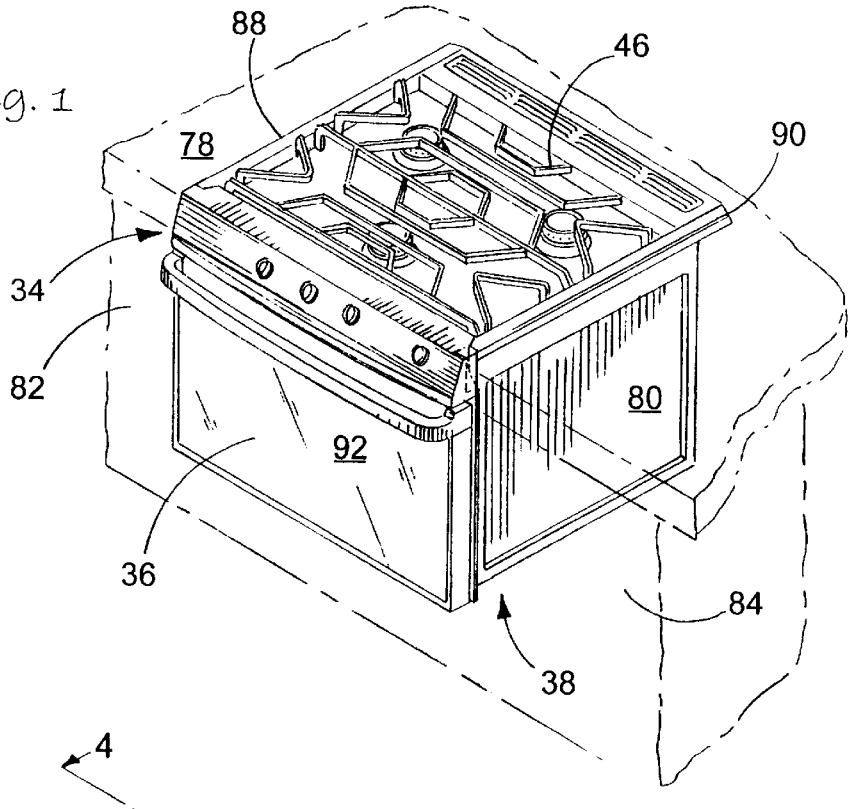
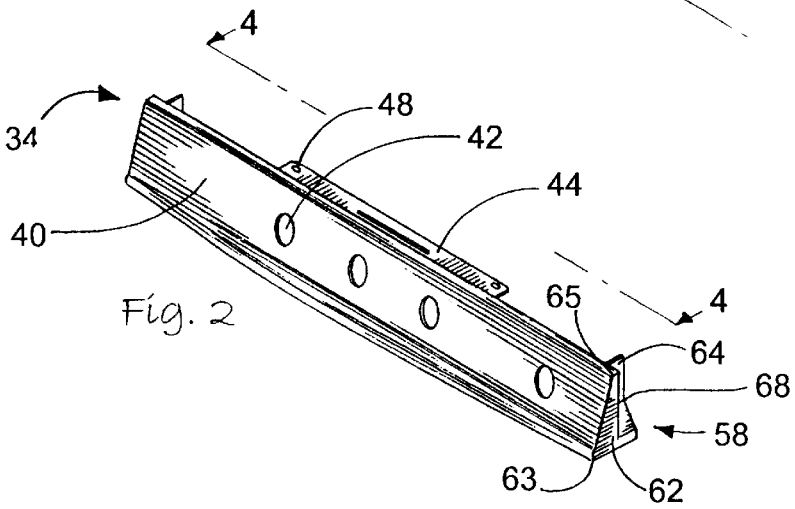
Fig. 2
Fig. 4
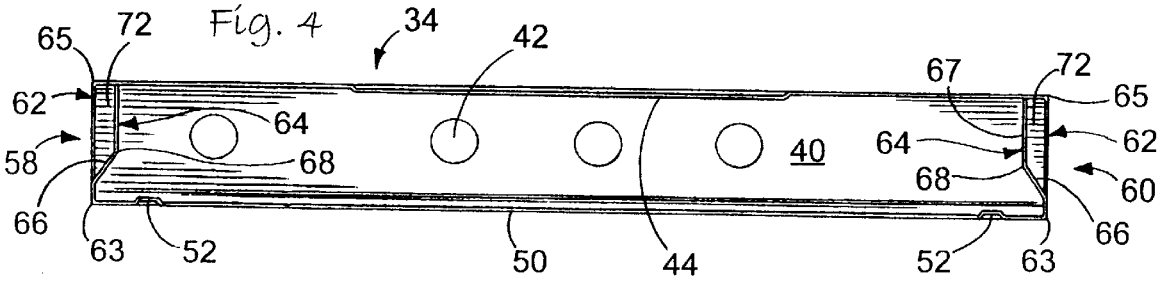

RANGE FOR A RECREATIONAL VEHICLE WITH NOTCHED CONTROL PANEL

FIELD OF THE INVENTION

The present invention generally relates to cooking ranges, and more particularly relates to cooking ranges for use on recreational vehicles.

BACKGROUND OF THE INVENTION

Modern recreational vehicles include many of the modern amenities of free-standing homes. It is not uncommon for the recreational vehicle to include, in addition to sleeping and living quarters, a full-service kitchen as well. One of the appliances which is typically provided in such a recreational vehicle kitchen, is a range which combines the functions of a convection oven with a stove-top having individual burners.

As with many manufacturing processes, recreational vehicles are manufactured in assembly line fashion where it is necessary to minimize the labor required, and thus time and cost required, for manufacturing each vehicle. Every facet of the assembly process is under scrutiny with improvements constantly being implemented, discovered and sought.

One bottle-neck of the assembly process which is currently troublesome to the industry and results in excessive labor costs and time, is the installation of the aforementioned ranges. Ranges are commonly provided with a front face which includes the oven door and control panel which is wider than the oven chamber and which is provided with dimensions so as to fit into an opening provided in the kitchen cabinetry and countertop. Rather than have the range fully fit within the rectangular opening of the countertop and thereby provide a gap between the sides of the range and the sides of the kitchen cabinet, it is desirable to provide side flanges on the range which overlap the kitchen cabinetry and countertop to thereby provide for a more aesthetically pleasing appearance wherein the range blends into the countertop and kitchen cabinet.

However, given the current configuration of ranges, wherein the range front face includes a door and control panel, the countertop must be provided with rectangular cut-outs or notches to receive the control panel therein in order for the range to be fully recessed into the kitchen cabinet. This necessarily increases the labor, time and cost required for manufacture of the recreational vehicle and, thus, the overall cost to the manufacturer and, ultimately, the consumer.

SUMMARY OF THE INVENTION

It is therefore a primary aim of the present invention to provide a range for a recreational vehicle which can be quickly recessed into a simple rectangular cut-out provided in the kitchen cabinet and countertop of a recreational vehicle.

It is an objective of the present invention to accomplish the foregoing aim while minimizing the changes required for a conventional range and thus minimizing the cost of the alteration.

It is a feature of the present invention to accomplish the foregoing by providing a range having a top, bottom, front, back, and two opposed sides forming an oven wherein the top overlaps the opposing sides to thereby form flanges which are adapted to abut the top surface of a countertop when the range is slid into a rectangular opening in a kitchen cabinet, wherein the front includes overlapping sides to thereby form side flanges which abut a front face of the cabinet when the range is slid into the rectangular opening, and wherein a control panel is provided as part of the range front and which includes notched sides to receive the sides of the countertop, while still allowing the range to be fully recessed into the rectangular opening and allowing the top and side flanges to abut the countertop and kitchen cabinet, respectively, to create an aesthetically pleasing appearance.

It is another feature of the present invention to form the control panel from a single piece of stamped metal to thereby minimize the labor cost and time required for assembly of the range.

These and other objects and features of the present invention will become more apparent from the following detailed description when taken in conjunction with the accompanying drawings.

BRIEF DESCRIPTION OF THE DRAWINGS

FIG. 1 is a perspective view of the present invention showing the countertop adapted to receive the range in phantom lines;

FIG. 2 is a perspective view of the notched control panel of the present invention;

FIG. 4 is back view of the control panel of the present invention;

Figure 3:
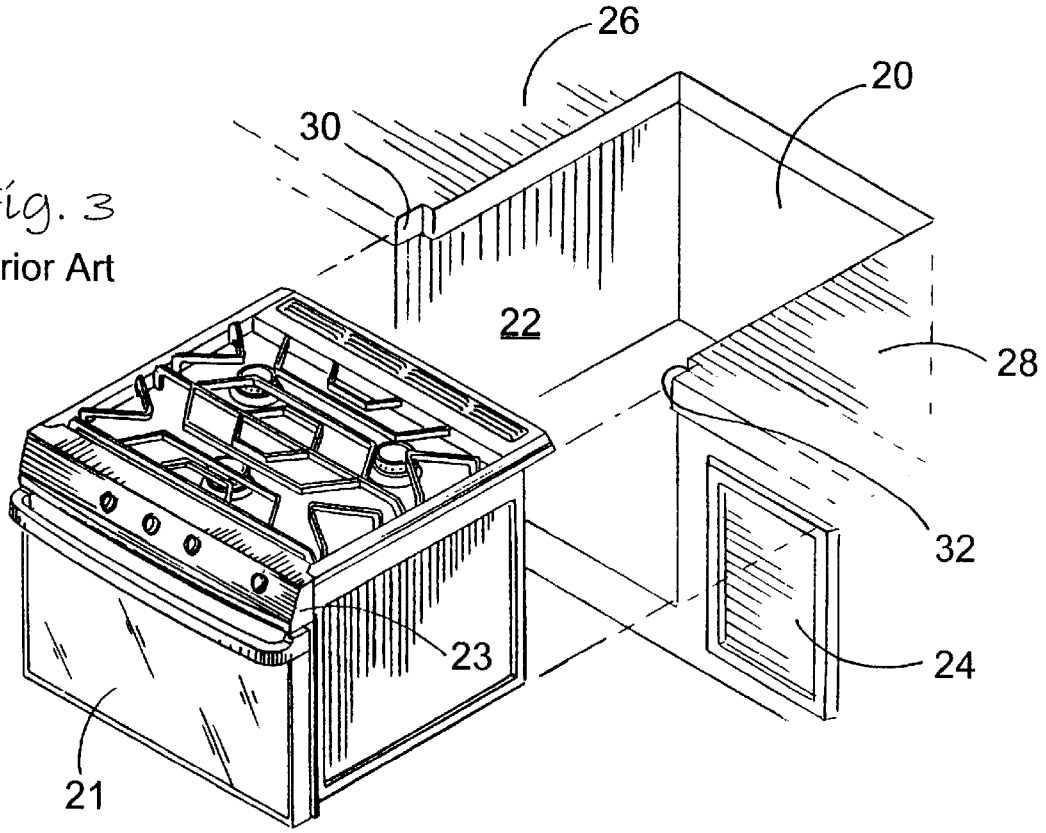
Fig. 3 Prior Art
FIG. 3 is a perspective view of a prior art range showing the notched countertop required to receive such a prior art range.

While the present invention is susceptible of various modifications and alternative constructions, certain illustrative embodiments thereof have been shown in the drawings and will be described below in detail. It should be understood, however, that there is no intention to limit the present invention to the specific forms disclosed, but on the contrary, the intention is to cover all modifications, alternative constructions and equivalents falling within the spirit and scope of the present invention as defined by the appended claims.

DETAILED DESCRIPTION OF THE PREFERRED EMBODIMENT

As stated in the background section of the application, the countertop of a recreational vehicle kitchen cabinet has heretofore had to be configured in such a way so as to fully receive the range in the opening provided in the countertop, while still providing room for the side and top flanges of the range to abut the kitchen cabinet and countertop to provide an aesthetically appealing appearance. Alternatively, the range can be provided without flanges and thereby be fully recessed into a simple rectangular cut-out provided in the countertop. However, such a system leaves gaps separating the range from the countertop which detract from the appearance of the range and, moreover, create crevices inviting food particles and other debris to fall therein and create an unclean, as well as unattractive, unit. These gaps could be filled with a molding of some sort, but, as stated above, it is desirable to minimize the labor and cost required for fabrication of these recreational vehicle kitchens, and such an additional step not only adds time but adds to the overall cost of the system as well.

To provide a more complete understanding of the problem which the present invention overcomes, FIG. 4 is provided to show the amount of modification needed to be made to a recreational vehicle countertop in order to receive a conventional, prior art range 21. As shown therein, a rectangular opening 20 is provided to receive the range 21. Opening 20 is typically not provided by cutting out the opening, but rather provided by positioning adjacent cabinets next to one another with opening 20 being provided therebetween. The result is a pair of kitchen cabinets 22 and 24 each having a countertop 26 and 28 respectively, provided thereon. Since the countertops 26 and 28 are conventionally provided in planar sheets, notches 30 and 32 must be manually cut, or otherwise fabricated, into the countertops to receive control panel 23 of the range 21. While such an additional step is simple to perform, it is nonetheless an additional step which necessarily slows the assembly process, adds additional work-hours to the assembly, and thus adds cost to the overall system.

It would therefore be much more advantageous if the rectangular opening 20 could simply be left intact and the step of creating notches 30 and 32 could be eliminated. The present invention accomplishes this and thereby streamlines the assembly process and reduces the overall labor and cost of the resulting recreational vehicle by providing the range with an inventive control panel 34. As shown in FIG. 1, control panel 34 is adapted to be placed on front 36 of range 38. Front panel 40, as perhaps best shown in FIG. 2, is additionally provided with a plurality of apertures 42 which allow control hardware to pass therethrough and, as shown on FIG. 1, receive control knobs for control of the oven and stovetop valves.

In addition to front panel 40, control panel 34 is provided with a top flange 44 which is provided for attachment of control panel 34 to cook top 46. As best shown in FIG. 2, top flange 44 is provided with a plurality of apertures 48 to receive fasteners for connection of flange 44 to cook top 46. Similarly, control panel 34 is provided with a bottom flange 50 (see FIG. 3) for additional attachment of control panel 34 to cook top 46. Bottom flange 50 includes a pair of recessed apertures 52 and cutouts 54 for attachment purposes, and a plurality of ventilation holes 55 for dissipation of the heat generated by range 38 and directed toward control panel 34.

Although the aforementioned features of control panel 34 are included in the present invention, the most inventive features of the present invention are embodied in the configuration of side panels 58 and 60. As shown in FIG. 3, side panels 58 and 60 are of an identical design having a planar portion 62 and a curvilinear portion 64. Planer portion 62 tapers in width from a maximum width point 63 where it abuts bottom flange 50 to a minimum width at nexus 65 with top flange 44.

Figure 5:
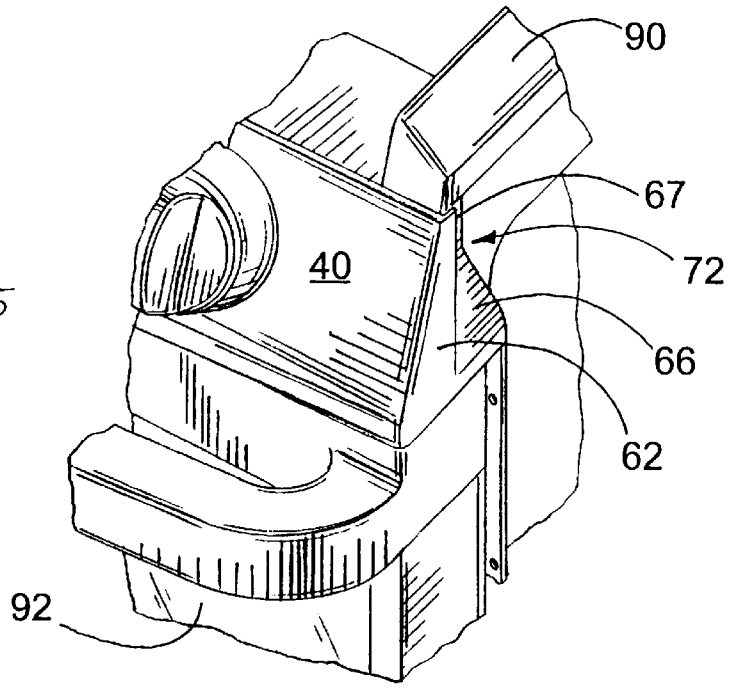
FIG. 5 is an enlarged perspective view of one corner of the range showing the notched control panel.

Curvilinear portion 64 is of a constant width but is configured so as to immediately angle inward from the nexus 65 to form angled section 66 (see FIG. 5). At an inner position referenced by numeral 68, curvilinear portion 64 straightens and is directed toward top flange 44 to form straight section 67 which is parallel to planar portion 62.

It can therefore be seen that a notch or recess 72 is formed in side panels 58 and 60. It is these notches 72 which receive the corners of countertops 78 and 80 shown in FIG. 1. The respective FIGS. 1 and 3 show the dramatic difference which the present invention brings to the art. As opposed to the prior art countertop shown in FIG. 3, countertops 78 and 80 of the present invention need not be additionally configured once they are installed on cabinets 82 and 84. Rather range 38 can simply be slid into a simple rectangular opening. The additional labor required for cutting notches 30 and 32 of the prior art countertop is simply not necessary.

Rather, by configuring the control panel 34 of the present invention as described above, the assembled range can simply be slid into a rectangular opening with the corners of countertops 78 and 80 being received into notches 72. The front panel 40 will overlap countertop 78 and 80 and range 38 will be fully recessed into the rectangular opening with top flanges 88 and 90 resting on top of countertop 78 and 80 to provide the appearance that the range 38 "blends into" the kitchen cabinetry. Moreover, door 92 will also be manufactured of a width sufficient to overlap cabinets 82 and 84 and thereby provide for an aesthetically appealing appearance. The present invention therefore provides a range which eliminates unnecessary labor and costs by designing the range to be able to be recessed into a simple rectangular cutout provided in any kitchen cabinet.

Figure 6:
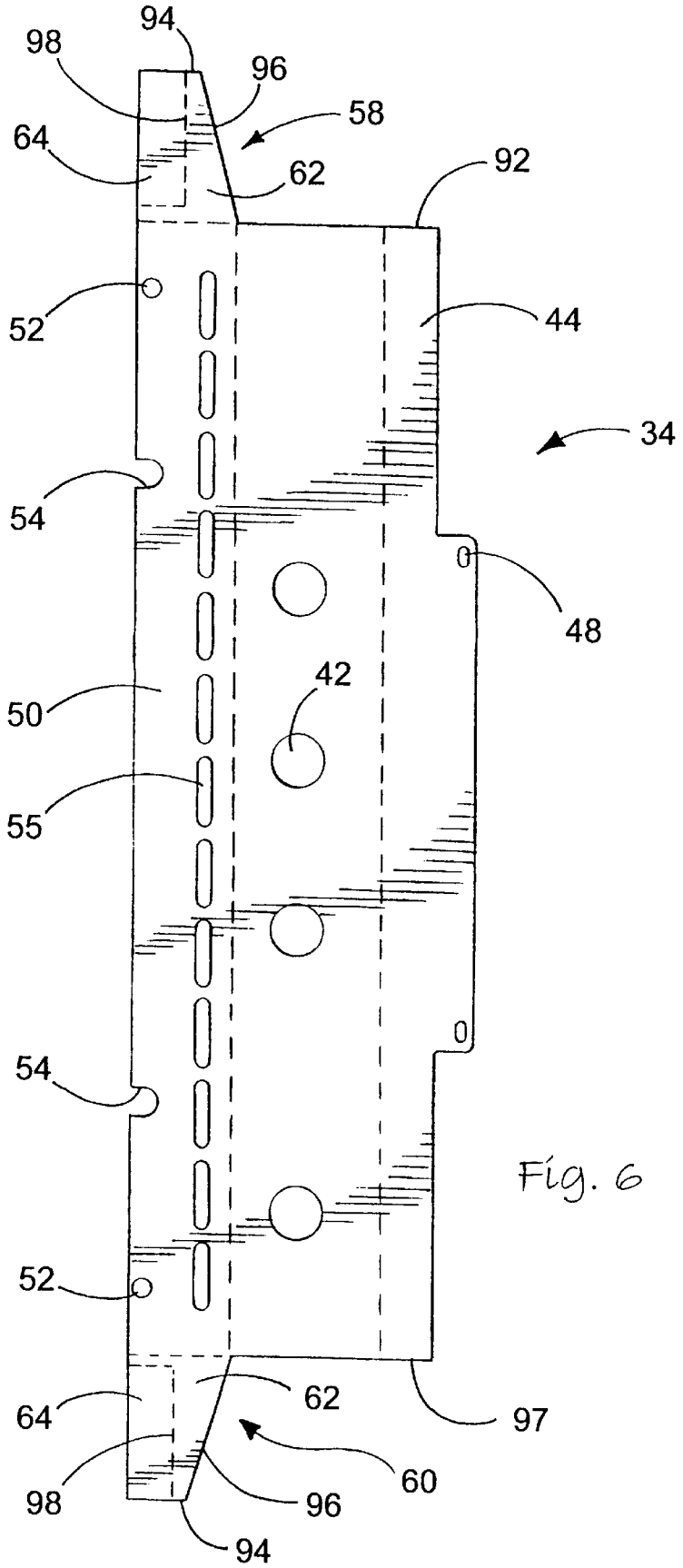
FIG. 6 is a plan view of the stamping used to form the control panel of the present invention.

The inventive features of the present invention not only include control panel 34, but also the method by which control panel 34 is fabricated. As best shown in FIG. 6, control panel 34 is initially formed from a single stamping of sheet metal. The stamping is initially a planar member wherein top flange 44 and bottom flange 50 are integral with front panel 40, and are then drawn substantially perpendicular to front panel 40 during a first step of the fabrication process. Side panels 58 and 60, which are integral with bottom flange 50, are then drawn perpendicular to bottom flange 50 such that ends 94 of planer portion 62 abut top flange 44. The nexus between sides 96 of planer portion 62 and 97 of top flange 44 are then welded together. Curvilinear portion 64 is then drawn into the desired angular shape and, given the rigidity of the sheet metal, the sheet metal retains this shape. As can be seen from FIG. 6, planar portion 62 is originally integral with curvilinear portion 64 but is separated therefrom by incision 98.

It can therefore be seen that the present invention not only provides a range which can be quickly and efficiently installed into a simple rectangular cutout provided in a countertop of a recreational vehicle, but also streamlines and optimizes the fabrication process for the inventive control panel 34 of the present invention. By providing a design which allows control panel 34 to be fabricated from a single planar piece of sheet metal, it can be manufactured from a relatively quick process of stamping, drawing, and welding. The notches 72 of side panels 58 and 60 therefore need not be formed from a complicated process, but can be quickly and efficiently performed and control panel 34 can be directly installed onto range 38 for ultimate installation into a recreational vehicle.

From the foregoing, it can be seen that the present invention brings to the art a range for installation into a recreational vehicle kitchen which minimizes the labor required for installation, the time required for installation, and, ultimately, the cost of the overall product. Moreover, the present invention provides a range for use in a recreational vehicle which can slide into a simple rectangular opening in a countertop and blend in without additional molding or other required hardware.

What is claimed is:

1. A range adapted to be slid into a rectangular opening formed in a kitchen cabinet and a countertop, the range comprising, in combination:

a top including means for stove-top cooking, and a front; and a control panel comprising, a front face, a top flange and a bottom flange extending from the front face for attaching the control panel to the range, and two opposed sides, each side having a planar portion spanning from the top flange to the bottom flange and a curvilinear portion spanning from the bottom flange to the top flange at a point recessed inward from the planar portion, each curvilinear portion cooperating with the planar portion to define a recessed notch proximate the top;

wherein the notches are adapted to receive the countertop, and the sides are adapted to abut the cabinet when the range is slid into the rectangular opening.

2. The range of claim 1 further comprising an oven having a door, wherein the front face of the control panel is flush with the door having a front face flush with the door and also having two opposed sides, the notches being provided in the opposed sides.

3. The range of claim 2 wherein the control panel is fabricated from a single piece of drawn sheet metal.

4. The range of claim 1 wherein the control panel includes a plurality of apertures adapted to receive hardware therethrough, the hardware being adapted to receive a control knob to enable the range to be controlled.

5. A control panel for a range adapted to slide into a rectangular opening provided in a kitchen cabinet having a countertop, the countertop having a front edge and two internal side edges forming a rectangular opening, the control panel comprising:

a front face having a first side edge, a second opposed side edge, a top edge and a bottom edge;

a top flange connected to the top edge of the front face and a bottom flange connected to the bottom edge of the front face for attachment of the control panel to the range; and two opposed sides, the two sides each having planar portions spanning from the top flange to the bottom flange adjacent the first and second side edges, the two sides each further including a curvilinear portion spanning from the bottom flange proximate the side edge to the top flange at a point recessed inward a predetermined distance from the planar portion to thereby form a notch being adapted to receive the first and second side edges of the countertop when the range is slid into the rectangular opening, the countertop side edges abutting the curvilinear portion, the countertop front edge abutting the planar portion.

6. The control panel of claim 3 wherein the front face includes a plurality of apertures adapted to receive hardware therethrough for control of the range.

7. The control panel of claim 5 wherein the control panel is fabricated from a single piece of drawn sheet metal.

8. A method for forming a control panel for a recreational vehicle range comprising, in combination, the following steps:

stamping a template from sheet metal stock wherein the template includes a front panel with adjoining top and bottom flange sections and wherein the bottom flange includes adjoining side panels;

bending the top flange so as to be perpendicular to the front panel;

bending the bottom flange so as to be perpendicular to the front panel;

cutting an incision into the side panels to form planar portions and curvilinear portions;

bending the planar portion and the curvilinear portion of each side panel to be perpendicular to the bottom flange to cooperatively form a recessed notch, and welding the planar portions to the front panel and the top flange.

9. The method of claim 8 further including the steps of attaching the control panel to the recreational vehicle range and sliding the range into a rectangular opening in a countertop, the countertop having front corners which are received within the recessed notches.

10. The method of claim 8 wherein the welding step is performed by spot welding.

* * * * *